US005911607A

United States Patent [19]

Lacko et al.

[11] Patent Number: 5,911,607

[45] Date of Patent: Jun. 15, 1999

[54] SEALING ASSEMBLY FOR PROPELLER DRIVE SHAFT

[76] Inventors: Mark A. Lacko, Rte. 9D, P.O. Box 168, Garrison, N.Y. 10524; John R. Newton, 207 Elsa Rd., Jupiter, Fla. 33477

[21] Appl. No.: 08/931,589

[22] Filed: Sep. 16, 1997

[51] Int. Cl.[6] ..... B63H 23/36

[52] U.S. Cl. ..... 440/83; 440/112; 277/585; 277/572

[58] Field of Search ..... 440/112, 49, 83; 384/98, 97, 477, 484; 277/346, 585, 572, 551

[56] References Cited

U.S. PATENT DOCUMENTS

| | | | |
|---|---|---|---|
| 676,889 | 6/1901 | Gasparini | 440/83 |
| 3,565,447 | 2/1971 | Hans Peter Goetze | 440/112 |
| 3,889,626 | 6/1975 | Kakihara | 115/34 |
| 5,370,400 | 12/1994 | Newton et al. | 277/12 |
| 5,503,404 | 4/1996 | Newton et al. | 277/9.5 |
| 5,639,098 | 6/1997 | MacDonald | 277/88 |
| 5,795,198 | 8/1998 | Pedone | 440/2 |

FOREIGN PATENT DOCUMENTS

| | | | |
|---|---|---|---|
| WO 96/05100 | 2/1996 | WIPO | 23/36 |

*Primary Examiner*—Sherman Basinger
*Assistant Examiner*—Mark A. Lacko
*Attorney, Agent, or Firm*—Michael Ebert

[57] ABSTRACT

A sealing assembly for a rotary drive shaft that extends through the hull of a boat, the outboard end of the shaft being coupled to a propeller and the inboard end to a marine engine for rotating the propeller. The assembly includes a cylindrical housing joined by a flexible hose to a tube in the stern of the boat through which the shaft passes. Received within the housing is an annular bearing whose bore diameter depends on the size of the shaft whereby the bearing installed in the housing has an internal diameter appropriate to the size of the shaft being sealed by the assembly. Coupled to one end of the housing is an annular cap having an elastomeric lip seal therein that frictionally engages the shaft to prevent sea water from leaking into the boat. A reservoir defined by an annular space within the housing between the lip seal and the bearing is continuously fed with water to cool and lubricate the lip seal.

13 Claims, 4 Drawing Sheets

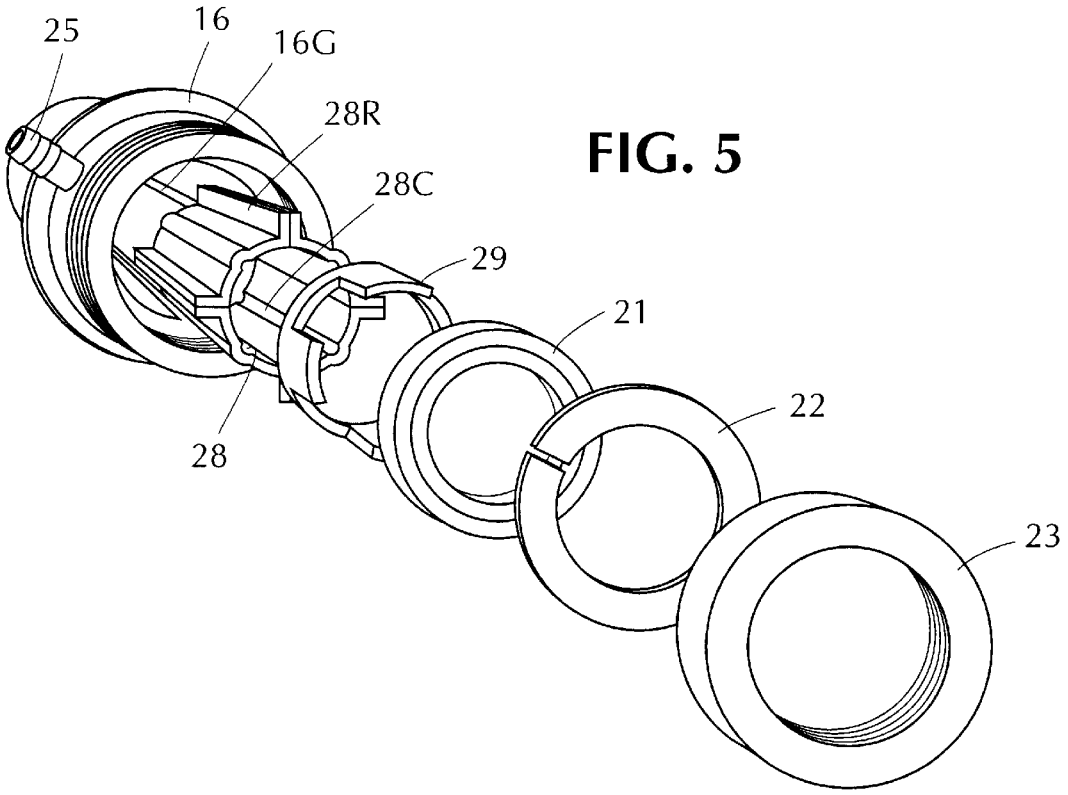
FIG. 5
FIG. 6
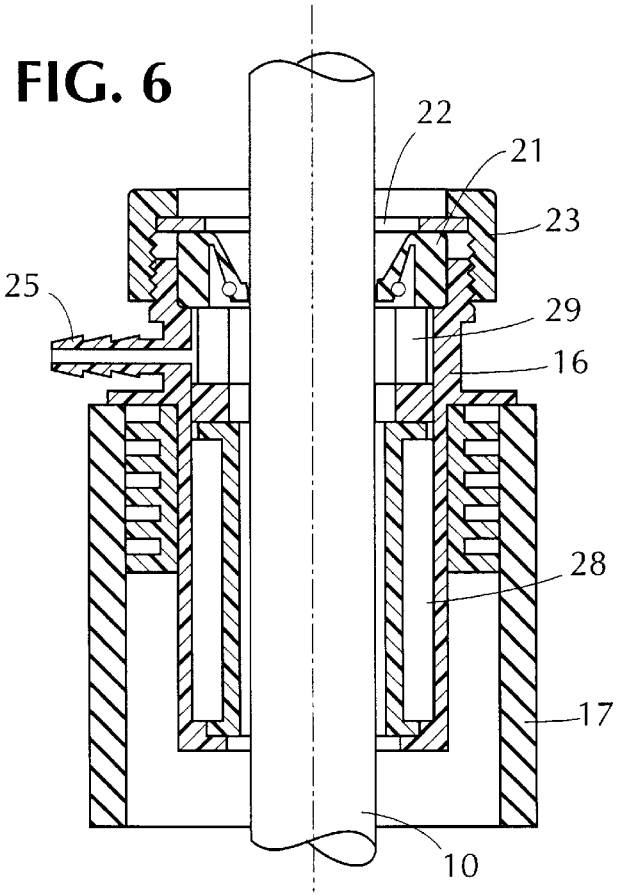

SEALING ASSEMBLY FOR PROPELLER DRIVE SHAFT

BACKGROUND OF INVENTION

1. Field of Invention

This invention relates generally to a sealing assembly for a rotary drive shaft that extends through the hull of a boat to couple an inboard marine engine to an outboard propeller, and more particularly to an assembly of this type adapted to accommodate a range of different shaft sizes.

2. Status of Prior Art

In a propeller driven boat provided with an inboard marine engine, the engine is coupled by a rotary drive shaft which extends through a tube in the stern of the boat to an outboard propeller. In order to prevent sea water from leaking into the boat through the stern tube, a sealing assembly is required for this purpose which permits the shaft to rotate, but blocks the passage of sea water into the boat.

Of prior art interest are the sealing assemblies disclosed in the Newton et al. U.S. Pat. Nos. 5,370,400 and 5,503,404. In each of these assemblies, a cylindrical bearing is provided through which the shaft extends. Engaging the shaft adjacent to one end of the bearing is a lip seal that serves to prevent sea water passing through the bearing from leaking into the boat.

Formed within the cylindrical body of the bearing is an annular reservoir within which the lip seal is positioned. The engine's cooling water is fed into the reservoir and discharged therefrom through a channel in the shaft back to the sea. This circulating flow of water acts to lubricate and cool the lip seal and thereby maintain it in working order. In the absence of such lubrication, the heat generated by the friction between the shaft and the seal would in time render the seal ineffective.

In the sealing assemblies disclosed in the Newton et al. patents, the cylindrical bearing is formed of an ultra-high molecular weight polymer (UHMW-polyethylene) possessing a very low coefficient of sliding friction. This cylindrical bearing for the drive shaft is coupled to the through tube in the stern of the boat by a flexible rubber hose that surrounds the shaft. Thus sea water entering the stern tube is confined within the hose and the bearing.

The Newton et al. sealing assemblies operate efficiently and are highly reliable. However, these assemblies are useable only with drive shafts for which they are expressly designed. Thus the UHMW bearing must be machined to have an internal diameter that will accommodate a given drive shaft size and no other. If therefore it becomes necessary to provide a sealing assembly for other drive shaft sizes, UHMW bearings must then be machined to accommodate each of these different sizes. And one must also provide various other components for the assembly that are appropriate to the shaft sizes.

Because of its extremely low friction characteristics, the use of UHMW material is desirable in a marine shaft bearing. But the nature of this material is such that when subjected to excessive compression, it becomes distorted and cold flows. In a sealing assembly of the Newton et al. type, the hose from the stern tube is joined to the UHMW bearing and is clamped thereto by metal bands. When these bands are tightened to avoid leakage, they may then subject the UHMW material to a compressive force sufficient to cause this material to cold flow. As a consequence, the UHMW bearing will bind on the shaft passing therethrough and thereby resist rotation of the shaft.

Another drawback of a UHMW bearing in a sealing assembly is that water lubrication is essential in order to ensure that the shaft rotates freely within the bearing. Should no lubricating water be present as a result of a blockage or a pinched line, the UHMW bearing will then immediately heat up and grab the shaft, the bearing material then softening. Should a catastrophic failure of the bearing cause the hose to tear free, water will then gush into the boat through the stern tube.

In sealing assemblies of the type disclosed in the Newton et al. patents, a lip seal of the appropriate size is pressfit with a 0.030 interference into one end of the UHMW bearing to ensure that no leakage occurs around the perimeter of the seal. Encircling this end of the bearing is a stainless steel band. Because of the tight press fit of the lip seal, it becomes very difficult to remove a worn seal and to replace it without in the process of doing so, damaging the bearing or nicking and scratching the shaft.

Yet another practical problem encountered with a sealing assembly of the Newton et al. type is that its cylindrical UHMW bearing which is coupled by a flexible base to the stern tube in the boat cannot be accommodated to stern tubes of different size. The reason for this limitation is that the external diameter of the bearing is machined to match the diameter of a given stern tube. In this way, one end of the coupling hose fits over the flow tube and the other end over the bearing. But if the boat has a stern tube of larger diameter than that of the bearing, a hose that fits onto this stern tube will be not fit snugly on the bearing.

SUMMARY OF INVENTION

In view of the foregoing, the main object of this invention is to provide a sealing assembly for a propeller drive shaft extending through the hull of a boat which is adapted to accommodate shafts in a range of different sizes.

More particularly, an object of this invention is to provide an assembly of the above type having a cylindrical housing in which is receivable an annular bearing whose internal diameter is appropriate to the size of the shaft to be passed therethrough, whereby for shafts of different size, placed in the housing are bearings appropriate thereto.

Also an object of the invention is to provide a sealing assembly having a cylindrical housing which is coupled by a flexible hose to a stern tube whose diameter is greater than that of the housing, the diameter of the housing being enlarged by a collar to fit the hose.

A significant advantage of an assembly in accordance with the invention is that it can be accommodated not only to drive shafts of different size, but also to stern tubes of different size.

Yet another object of the invention is to provide a sealing assembly that includes a lip seal that is retained in one end of a cylindrical housing by a threaded cap in an arrangement that facilitates the replacement of a worn seal.

Briefly stated, these objects are attained by a sealing assembly for a rotary drive shaft that extends through the hull of a boat, the outboard end of the shaft being coupled to a propeller and the inboard end to a marine engine for rotating the propeller. The assembly includes a cylindrical housing joined by a flexible hose to a tube in the stern of the boat through which the shaft passes.

Received within the housing in an annular bearing whose bore diameter depends on the size of the shaft whereby the bearing installed in the housing has an internal diameter appropriate to the size of the shaft being sealed by the assembly. Coupled to one end of the housing is an annular cap having an elastomeric lip seal therein that frictionally engages the shaft to prevent sea water from leaking into the boat. A reservoir defined by an annular space within the housing between the lip seal and the bearing is continuously fed with water to cool and lubricate the lip seal.

In a preferred embodiment of the sealing assembly which makes it possible to load its components one by one into the front end of the housing, the annular bearing within the housing is elongated and a spacer ring is interposed between one end of the bearing and lip seal to define the reservoir.

BRIEF DESCRIPTION OF DRAWING

For a better understanding of the invention, as well as further features thereof, reference is made to the detailed description thereof to be read in connection with the annexed drawings wherein:

FIG. 5 is an exploded view of an embodiment of the assembly in which front access is had to its housing to receive the bearing and other components; and FIG. 6 is a section taken through the front access assembly.

DETAILED DESCRIPTION OF INVENTION

First Embodiment

Figure 1:
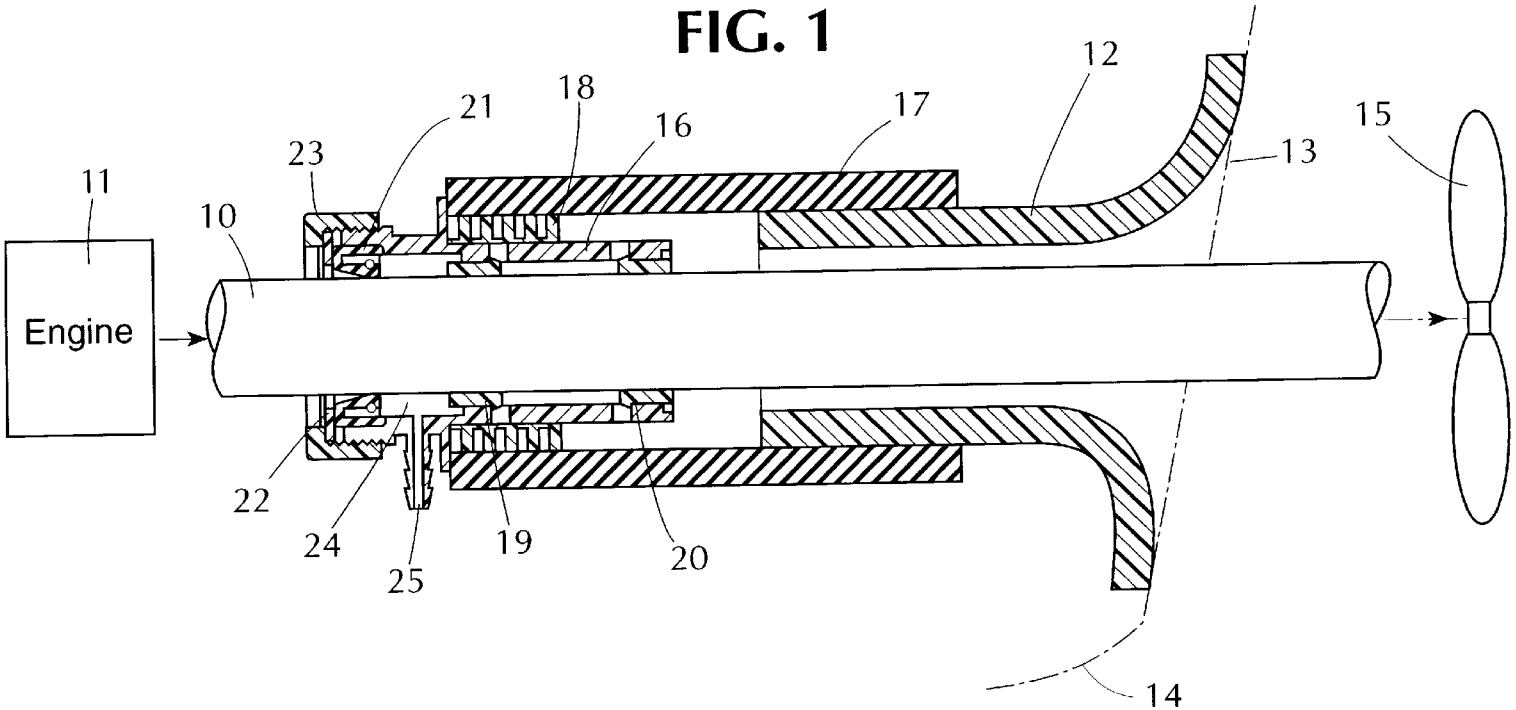
FIG. 1 is a longitudinal section taken through one preferred embodiment of a sealing assembly in accordance with the invention.
Figure 2:
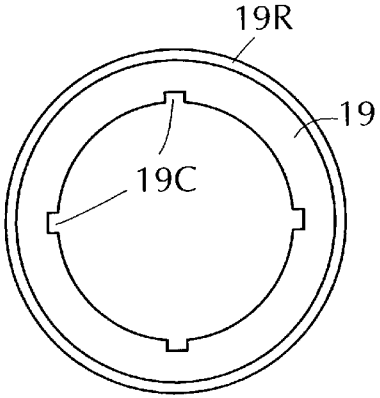
FIG. 2 is an end view of one annular bearing included in the assembly.

FIGS. 1 and 2 show a preferred embodiment of a sealing assembly in accordance with the invention installed on a propeller drive shaft 10 formed of stainless steel or other marine metal. The inboard end of shaft 10 is operatively coupled to the transmission of an inboard marine engine 11. Shaft 10 passes through a tube 12 mounted at the stern 13 of a vessel 14, the outboard end of the shaft being coupled to propeller 15.

Thus the engine acts via shaft 10 to rotate propeller 15. The assembly which serves to prevent seawater from leaking into the vessel while the shaft rotates, includes a cylindrical housing 16 injection molded of high-strength material, such as polypropylene. The housing may, in practice, be fiber-reinforced. Housing 16 is coupled to stern tube 12 through a flexible hose 17 formed of rubber or similar material that is water impermeable.

Flexible hose 17 which surrounds shaft 10 confines the flow of sea water entering through stern tube 12 so that it passes into housing 16, and it also permits the housing which is supported on shaft 10 to adjust itself to lateral shaft movements.

It will be seen in FIG. 1 that the internal diameter of hose 17 matches the external diameter of stern tube 12; hence the stern tube telescopes snugly into the hose. However the internal diameter of hose 17 is greater than the outer diameter of cylindrical housing 16. Hence in order to join housing 16 to the hose, fitted on the housing is a ribbed collar 18 of synthetic plastic material which occupies the free space between the housing and the hose so that the collar telescopes snugly into the hose. In practice, the hose is encircled by metal bands (not shown) which are tightened to clamp the hose onto housing 16 and onto stern tube 12.

Collar 18 which effectively serves to enlarge the external diameter of housing 16 so that it matches that of stern tube 12, is ultrasonically welded to the housing or threadably received thereon. The dimensions of the collar selected for a given sealing assembly depend on those of the stern tube installed in the boat. Since various boats are provided with stern tubes of different size, to accommodate a sealing assembly to these stern tubes it is only necessary for this purpose to use collars of appropriate size.

Received within cylindrical housing 16, at about its center, is an annular front bearing 19, and received in the housing adjacent its rear end is an annular rear bearing 20. These annular bearings are molded or otherwise formed of dimensionally stable PTFE material (TEFLON) having an extremely low coefficient of sliding friction. The internal or bore diameter of these annular bearings substantially matches the diameter of shaft 10 which rotates freely within the bearings.

Each annular bearing, such as bearing 19, shown separately in FIG. 2, is provided with a circumferential rib 19R which makes it possible to snap the bearing into a circumferential groove formed in housing 16 at the bearing position. The plastic material of the bearing is sufficiently resilient to permit the bearing to be snapped out of the groove when it becomes necessary to replace the bearing.

The inner bank of annular bearings 19 and 20 is provided, as shown in FIG. 2, in connection with bearing 19 with two pairs of diametrically-opposed channels 19C. These permit water to flow through the bearing along the shaft.

Received within the front end of housing 16 and mounted coaxially on shaft 10 is a lip seal 21 formed of elastomeric material, such as nitrile. Lip seal 21 is held in place by a split plastic washer 22 nested in an annular cap 23 that is threadebly received in the front end of housing 16. The interior wall of lip seal 21 is conically tapered and terminates in a resilient lip that frictionally engages the surface of shaft 10.

The advantage gained by the threaded cap and the split washer is that they facilitate replacement of a worn lip seal. To remove a worn lip seal, one has only to unscrew cap 23 from the end of the housing and slide it and split washer 22 forward on the shaft, thereby exposing the worn lip seal 21. Then the worn seal is gripped with a pair of pliers, pulled out of the end of the housing and cut off the shaft, after which the split washer is opened and removed from the shaft.

A fresh replacement seal is then slid down the shaft through the bore in annular cap 23 and pressed into the end of housing 16. The split washer is put back between the cap and the lip seal, the cap then being screwed back on the end of the housing and tightened. This tightening action acts to properly seat the seal 21 in the housing.

The annular free space within the housing between front bearing 19 and lip seal 21 defines a reservoir 24 which receives sea water passing along the shaft through channels 19C in the bearing when the engine is not running. When the engine is running, raw water from the engine's cooling system is forced into the reservoir through a line coupled to a fitting 25 integral with housing 16. The raw water is returned to the sea through channels 19C in the annular bearings 19 and 20 so that the water in the reservoir continuously circulates.

Because of heat generated by friction as the shaft rotate within lip seal 21, it is essential that the lip seal be cooled and lubricated at all times; otherwise the seal will be impaired. Such cooling and lubrication is effected by the water circulating in reservoir 24 in which the lip seal is immersed, the water acting to withdraw heat from the seal so that its resilient properties are retained. There is no build up of heat within the reservoir, for the water therein which collects the heat is discharged back to the sea.

Thus the sealing assembly illustrated in FIGS. 1 and 2 provides a very low friction bearing for a propeller shaft, and by means of its lip seal prevents sea water from leaking into the boat, the lip seal being cooled and lubricated to maintain it in working condition. Though bearings 19 and 20 are lubricated by water, because they are fabricated of Teflon, they do not require lubrication to maintain their very low friction properties, and should the flow of water be blocked for any reason, this will not overheat the bearings which will continue to support the lip seal in place on the rotating shaft.

Sealing Assemblies For Different Size Shafts

In installing a sealing assembly on a particular boat, the assembly must be capable of operating with the propeller drive shaft installed on that boat as well as with the installed stern tube. Sections A, B and C of FIG. 3 illustrate three different boat situations which must be accommodated by a sealing assembly in accordance with the invention of the type shown in FIG. 1.

Figure 3C:
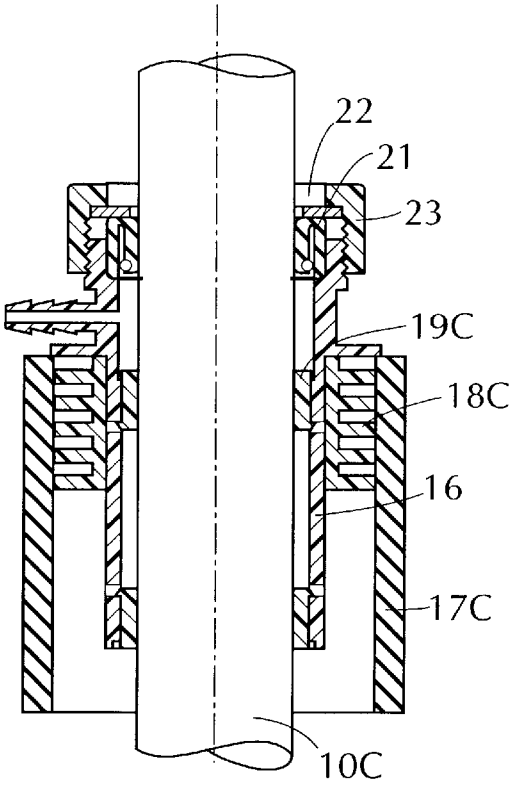
FIG. 3 in section A shows the assembly in conjunction with a drive shaft of small size; in section B it shows the assembly in conjunction with a medium size shaft, and in section C it shows the assembly in conjunction with a large size shaft.
Figure 3B:
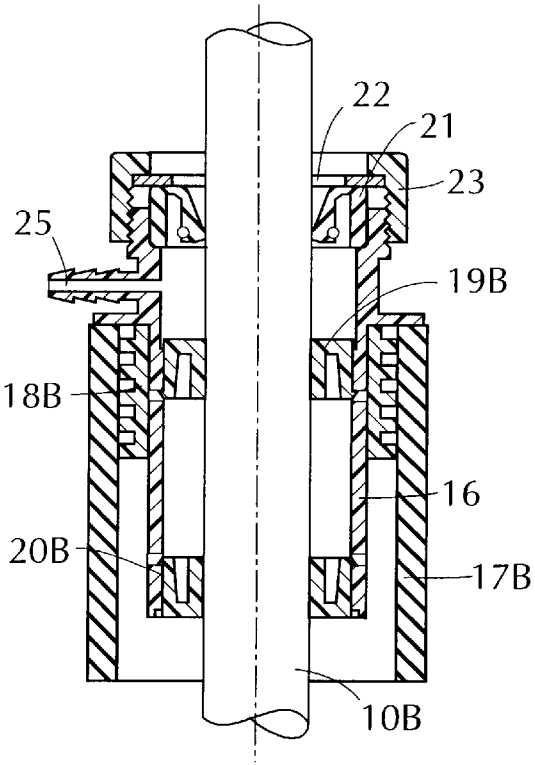
Figure 3A:
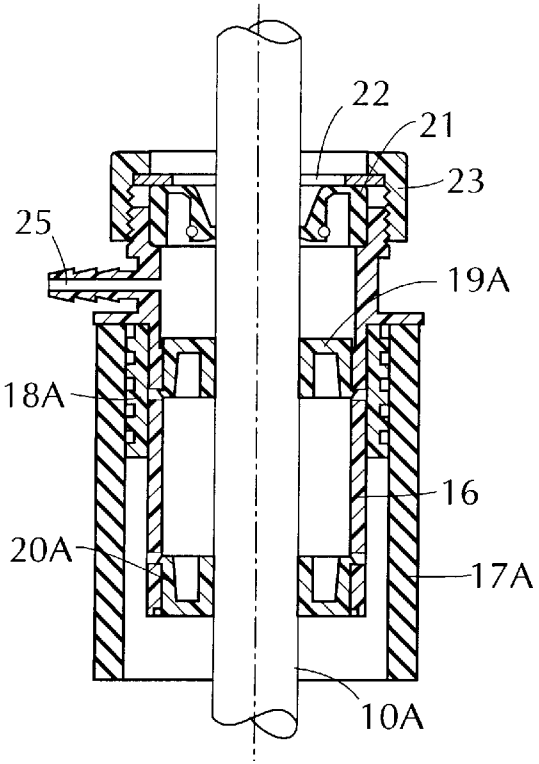

FIG. 3A shows a propeller drive shaft 10A having a small diameter and a flexible hose 17A that fits snugly onto a small diameter stern tube in a boat, but not on the housing 16 of even smaller diameter.

In order therefore for an assembly in accordance with the invention to accommodate itself to the situation illustrated in FIG. 3A, the front and rear annular bearings 19A and 20A received in cylindrical housing 16 must have a bore diameter matching the diameter of small size shaft 10A. Collar 18A which effectively enlarges the outer diameter of housing 16 must be dimensioned to occupy the free space between hose 17A and housing 16. Hence in this instance the collar has a relatively small diameter.

In FIG. 3B, shaft 10B is of medium size and hose 17B is also of medium size. Hence the bore in the front and rear annular bearings 19B and 20B now matches the diameter of shaft 10B, and the collar 18B interposed between housing 16 and hose 17B is dimensioned to fill the medium-sized space and therefore has a larger diameter than collar 18A.

FIG. 3C illustrates a situation in which shaft 10C has a large diameter, as does hose 17C. Hence in this case, annular bearings 19C and 20C must have a bore matching the large diameter of shaft 10C, and collar 18C interposed between housing 16 and hose 17C must be large enough to fill this broad space.

It is important to note that in FIGS. 3A, 3B and 3C, lip seal 21, split washer 22 and cap 23 remain the same as they are in FIG. 1, for the opening in cap 23 is large enough to receive any of the shaft sizes (small, medium and large), and the lip of the elastomeric lip seal will in each case frictionally engage the surface of the shaft. The cap opening is also large enough to allow through passage of a worn or new replacement seal. And in all of these situations, housing 16 of the assembly is unchanged, the only differences being in the bearings which snap into the housing and the collar that encircles the housing to enlarge its diameter to fit the hose.

All of the bearings, regardless of their bore size, have the same external diameter which is substantially the same as the inner diameter of cylindrical housing 16. Hence the bearings easily slide into the housing.

Thus regardless of the size of the drive shaft in the boat and the size of its stern tube, in order to produce a sealing assembly for this boat or any other boat, one uses the same cylindrical housing and the same cap therefor and lip seal. But the annular bearings received in this housing must be appropriate to the size of the shaft, and the collar attached to the housing must be appropriate to the size of the stern tube.

Second Embodiment

In the assemblies shown in FIGS. 1 and 3, lip seal 21 is received in the front end of the housing and is covered by screw-on cap 23 in which is nested split washer 22.

In the embodiment shown in sections A and B of FIG. 4, section A is a sealing assembly for a small size shaft 10A and section B is an assembly for a medium size shaft 10B.

Figure 4B:
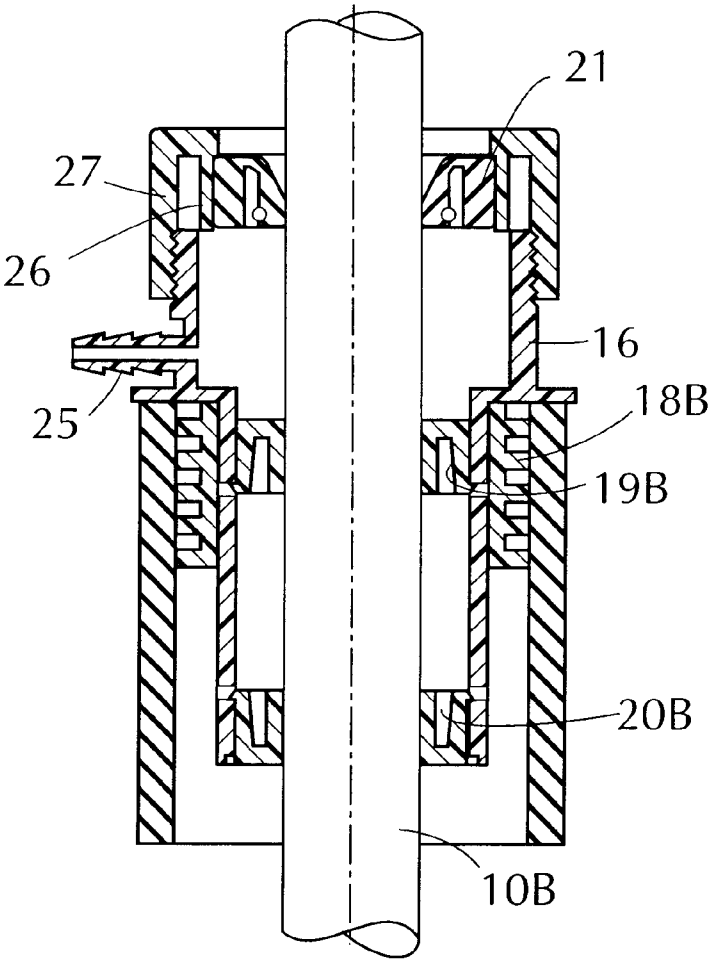
FIG. 4 in section A shows an assembly whose lip seal is anchored in a cap that screws onto the cylindrical housing through which extends a small size shaft, and in section B shows the same assembly through whose housing extends a medium size shaft.
Figure 4A:
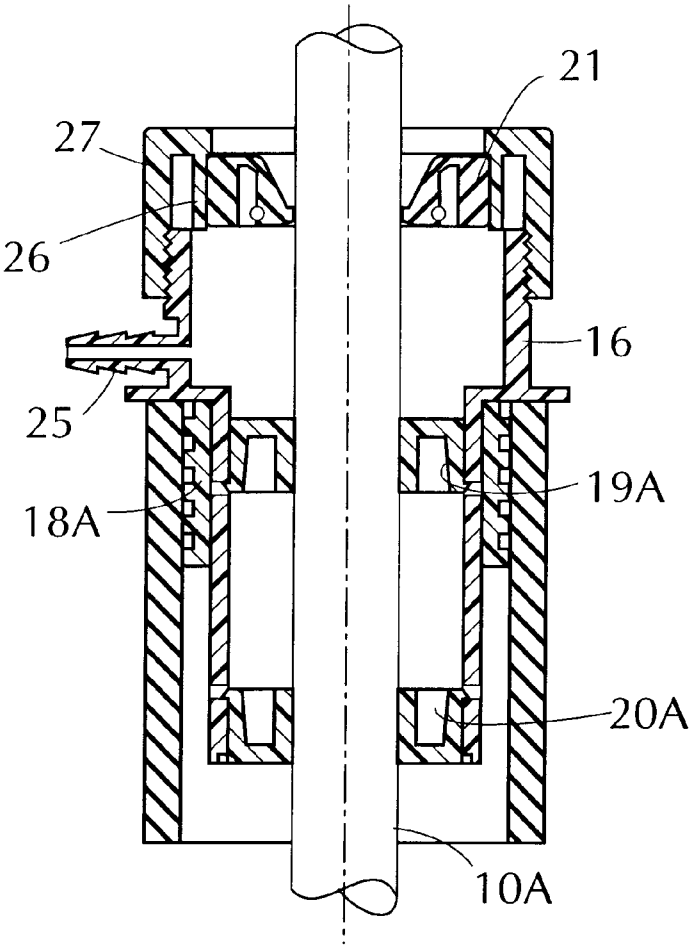

In FIG. 4A it will be seen that lip seal 21 is pressed into an internal cup 26 formed concentrically within threaded cap 27 which screws onto the end of housing 16. Received in this housing are front and rear annular bearings 19A and 20A whose bore size accommodates shaft 10A. FIG. 4B is the same as FIG. 4A, except that bearings 19B and 20B received in housing 16 have a bore size to accommodate medium size shaft 10B. In neither arrangement in which the lip seal is anchored in the cap is there a need for a split washer.

In a cap/lip seal unit as shown in FIGS. 4A and 4B, in order to replace a worn seal, the cap is unscrewed from the housing and slid on the shaft away from the housing. The entire unit is then cut free from the shaft and a replacement cap/lip seal unit is slid onto the shaft and screwed onto the housing. The outside diameter of cap 27 in FIG. 4A is the same as that of cap 27 in FIG. 4B.

Third Embodiment

In the embodiment of the sealing assembly shown in FIGS. 5 and 6, in which cylindrical housing 16 provided with a fitting 25 from which sea water is discharged, the assembly is essentially the same as in FIG. 1. However, in this embodiment the arrangement is such as to afford front access to the housing, the assembly being put together by inserting its components one by one into the front end of the housing.

To this end the annular bearing for the drive shaft 10 is not constituted by front and rear bearings, as in FIG. 1, but by an elongated bearing 28 formed of PTFE CTE whose bore is appropriate to the diameter of the shaft. Bearing 28 is provided with an inner array of channels 28C to permit the flow of sea water through the bearing along the shaft and an outer array of ridges 28R that slide into corresponding grooves 16G in the inner wall of housing 16. Hence in assembling the sealing assembly, bearing 28 is slid into housing 16.

Behind bearing 28 is a spacer ring 29 to define the annular reservoir between the bearing and lip seal 21 which goes behind the ring. Spacer ring 29 also prevents bearing 28 from moving fore or aft. And behind lip seal 21 is split washer 22, and behind this washer is the annular threaded cap 23 which screws onto the end of housing 16.

Hence with the front access arrangement shown in FIGS. 5 and 6, the same parts are used for all installations except for bearing 28 whose bore diameter must be appropriate to the size of the drive shaft. The advantage of this front access arrangement in which the components of the assembly are loaded one-by-one into the front end of the housing is that it makes it possible to change the bearing from the front without the boat having to undergo dry dock. This is especially advantageous with yachts and other ocean going craft.

While there has been shown and described preferred embodiments of a sealing assembly for a propeller drive shaft, it will be appreciated that many changes and modifications may be made therein without, however, departing from the essential spirit thereof.

We claim:

1. A sealing assembly for a drive shaft that extends from an inboard marine engine in a boat through a stern tube in the hull of the boat to an outboard propeller, said assembly acting to prevent sea water from leaking into the boat as the shaft is rotated by the motor; said assembly comprising:

A. a cylindrical housing joined by a flexible hose to said stern tube, said shaft extending from said engine through said housing, said hose and said tube to said propeller; said hose having an internal diameter which is such that said stern tube fits snugly therein, said housing having an outer collar secured thereto to enlarge its diameter whereby the collar telescopes into the hose;

B. at least one annular bearing slidable received within the housing having a bore whose diameter substantially matches the diameter of the shaft;

C. a lip seal coaxially mounted on the shaft adjacent one end of the housing the lip seal being spaced from the bearing to define therebetween an annular reservoir which receives water for cooling and lubricating the seal; and D. an annular cap coupled to said end of the housing to enclose the seal whereby the assembly is adapted to accommodate drive shafts in a range of different diameters by providing a bearing whose bore diameter is appropriate to the diameter of the shaft sealed by the assembly.

2. An assembly as set forth in claim 1, in which the housing is molded of synthetic plastic material.

3. An assembly is set forth in claim 2, in which integral with the housing is a fitting to admit water to the reservoir.

4. An assembly as set forth in claim 3, in which the engine is water-cooled and the water admitted into the reservoir is cooling water from the engine.

5. An assembly as set forth in claim 1, in which received in the housing is a front annular bearing and a rear annular bearing through which the shaft extends.

6. An assembly as set forth in claim 1, in which the bearing is formed of PTFE material.

7. An assembly as set forth in claim 1, in which the bore of the bearing is provided with at least one channel to permit the flow of water along the shaft through the bearing.

8. An assembly as set forth in claim 1, in which the lip seal is held in place adjacent one end of the housing by a split washer mounted on the shaft.

9. An assembly as set forth in claim 1, in which the annular cap is provided with a concentric inner cup in which the lip seal is nested.

10. An assembly as set forth in claim 1, in which received within the housing is an elongated annular bearing and a spacer ring interposed between one end of said bearing and said lip seal to define said reservoir.

11. An assembly as set forth in claim 10, in which said bearing is formed of a synthetic plastic material having a low coefficient of sliding friction.

12. An assembly as set forth in claim 10, in which front loaded into the front end of the housing, one-by-one, is the elongated bearing, the spacer ring and the lip seal.

13. A sealing assembly for a drive shaft that extends from an inboard marine engine in a boat through a stern tube in the hull of the boat to an outboard propeller, said assembly acting to prevent sea water from leaking into the boat as the shaft is rotated by the motor; said assembly comprising:

A. a cylindrical housing, having a predetermined external diameter joined by a flexible hose to said stern tube, said shaft extending from said engine through said housing, said hose and said tube to said propeller; said hose having an internal diameter matching that of the stern tube and greater than the external diameter of the housing; a collar mounted on the housing to effectively enlarge its diameter to match that of the stern tube; and B. an annular bearing slidably received within the housing having a bore therein whose diameter substantially matches the diameter of the shaft.

* * * * *